United States Patent [19]

Gaskins

[11] Patent Number: 4,461,081

[45] Date of Patent: Jul. 24, 1984

[54] KNIFE-SAW IMPLEMENT

[76] Inventor: Thomas Gaskins, Cypress Knee Museum, Palmdale, Fla. 33944

[21] Appl. No.: 461,452

[22] Filed: Jan. 27, 1983

[51] Int. Cl.[3] ..... B26B 11/00; B25F 1/00

[52] U.S. Cl. ..... 30/144; 30/166 A; 7/148

[58] Field of Search ..... 7/148, 158, 170; 30/144, 166 R, 166 A

[56] References Cited

U.S. PATENT DOCUMENTS 187,483 2/1877 Rightor ..... 30/144

3,404,456 10/1968 Chilko ..... 145/108 R

*Primary Examiner*—Roscoe V. Parker

*Attorney, Agent, or Firm*—Mason, Fenwick & Lawrence

[57] ABSTRACT

A knife including a blade and a handle has a hollow sleeve connector removably positioned over its blade in the area adjacent the handle and a saw blade extends outwardly from the connector at an acute angle relative to the blade and includes a saw-tooth edge facing one edge of said blade. The saw-tooth edge of the saw blade is oriented at 45° relative to the knife blade so that an item to be sawed can be positioned in the angle between the knife blade and the saw blade so as to be sawed by oscillation of the knife handle.

7 Claims, 4 Drawing Figures

KNIFE-SAW IMPLEMENT

BACKGROUND OF THE INVENTION

The present invention is in the field of tools and is more specifically directed to a unique hand tool comprising a combination knife and saw.

Outdoorsmen and others frequently have need for a tool capable of cutting large limbs and the like which are of greater size than can be easily cut with a conventional hunting or similar type knife. Conventional saws, hatchets, and the like can obviously be used for this purpose; however, such conventional saws and the like are heavy, large, and bulky so as to make their use impractical in circumstances such as backpacking and hiking where excessive weight and size are disadvantageous.

Therefore, it is the primary object of the present invention to provide a small, lightweight, and compact means for enabling the sawing of limbs or the like but which can also be used in the manner of a conventional knife.

SUMMARY OF THE INVENTION

Achievement of the foregoing object of the invention is enabled by the preferred embodiment which comprises a knife having a rigid blade and handle to the blade of which a saw blade attachment is easily connectable. The saw blade is mounted on a female sleeve which slides downwardly over the knife blade to abut against the handle of the knife. The sleeve is connectable to the blade by a threaded machine screw which extends through a transverse opening provided in the blade so as to provide a rigid, fixed connection between the knife blade and the saw blade attachment. A saw blade extends outwardly from the sleeve at an angle of approximately 45° and faces the dull or back edge of the knife blade. A limb or other item to be cut by the saw blade is positioned between the back edge of the knife blade and the saw-tooth edge of the saw so that oscillation of the knife handle rapidly results in a sawing action on the item being cut.

A better understanding of the preferred embodiment will be achieved when the following detailed description is considered in conjunction with the appended drawings in which like reference numerals are used in the different figures for the same parts.

BRIEF DESCRIPTION OF THE DRAWING

FIG. 2 is a front elevation view illustrating the preferred embodiment as employed for cutting a limb or the like;

DESCRIPTION OF THE PREFERRED EMBODIMENT

Figure 1:
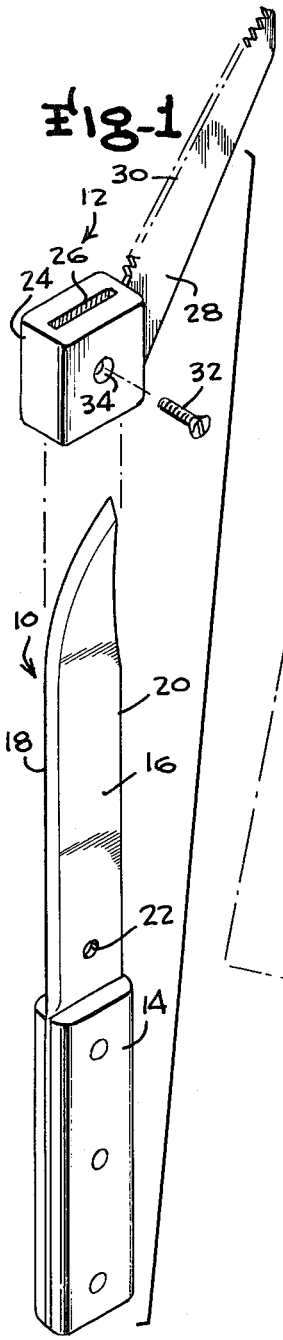
FIG. 1 is an exploded perspective view of the preferred embodiment of my invention.

Attention is initially invited to FIG. 1 of the drawings which illustrates the constituent components of the preferred embodiment which include a conventional knife 10 on which a saw blade attachment 12 is mountable. Knife 10 includes a handle portion 14 and a blade portion 16 with the blade including a sharp edge 18 and a dull or flat back edge 20. Blade 16 also includes a transversely extending mounting aperture 22 positioned in the blade in the area adjacent the handle 14.

The saw blade attachment 12 includes a hollow female sleeve member 24 having a rectangular slot 26 extending along its length and dimensioned so as to be matingly fittable over the knife blade 16. A saw blade 28 having a saw-tooth edge 30 extends outwardly from the sleeve 24 and is provided with a saw-tooth edge 30 which faces the dull back edge 20 of blade 16. It should be observed that saw-tooth edge 30 is oriented at approximately 45° with respect to the blade 16.

A machine screw 32 extends through an aperture 34 provided in sleeve 24 and also extends through aperture 22 in the blade 16 so as to provide for a locked connection of the saw blade attachment 12 on the blade.

Figure 2:
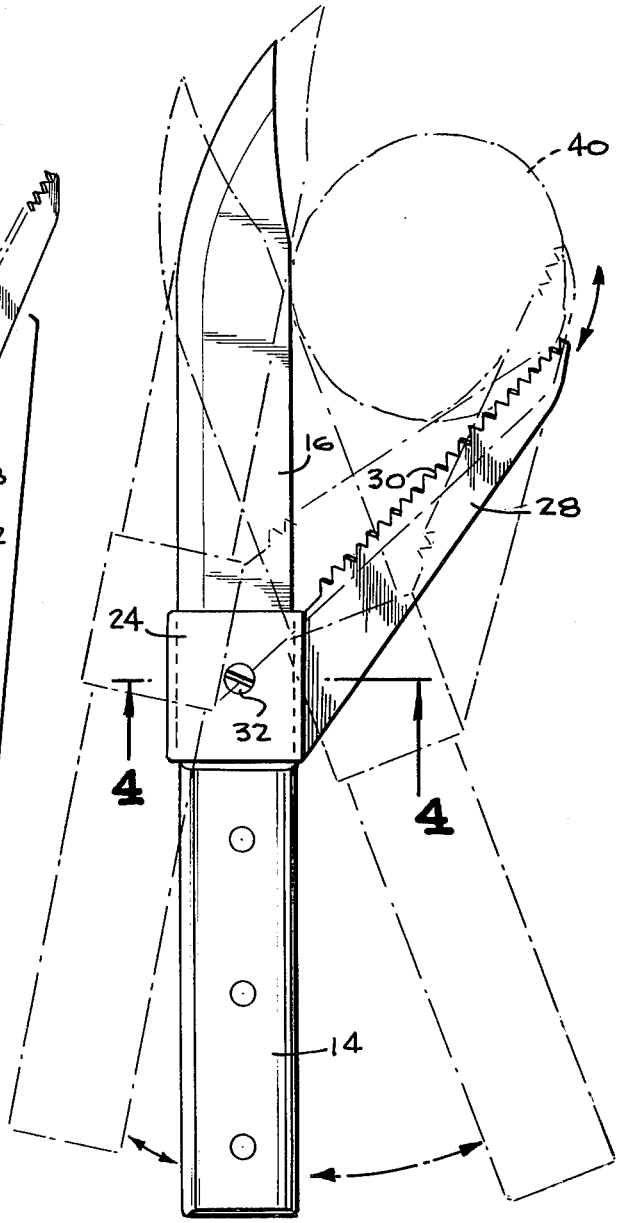
Figure 3:
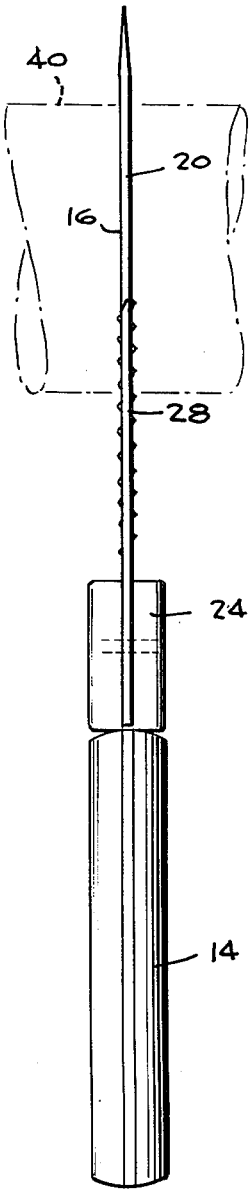
FIG. 3 is a side elevation view of the preferred embodiment.
Figure 4:
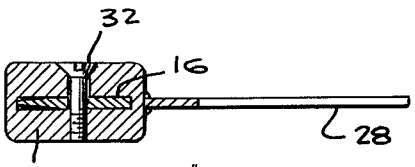
FIG. 4 is a sectional view taken along lines 4—4 of FIG. 2.

In use, the device is positioned with a limb or the like 40 engaging the dull edge 20 of the knife blade and the saw-tooth edge 30 of the saw blade attachment 12 as shown in FIG. 2. Oscillation of the handle 14 from the solid to dotted line positions illustrated in FIG. 2 results in a sawing action by the blade which will rapidly cut through the limb 40 in an obvious manner. On the other hand, when the device is desired to be used solely as a knife, the saw blade attachment 12 can be easily removed by simply removing the machine screw 32 and sliding the attachment 12 from the blade.

Numerous modifications of the preferred embodiment will undoubtedly occur to those of skill in the art. Therefore, it should be understood that the spirit and scope of the invention shall be limited solely by the appended claims.

I claim:

1. A multipurpose tool comprising a knife including a blade and a handle, connector means removably connectable to said blade in the area adjacent the handle of the knife and a saw blade extending outwardly from said connector means at an acute angle relative to said blade wherein said saw blade includes a saw-tooth edge facing one edge of said blade and said connector means comprises, a hollow sleeve member including a slot extending therethrough dimensioned so as to be matingly fittable over said knife blade.

2. The combination of claim 1 wherein said blade includes a transversely extending mounting aperture and said hollow sleeve member includes a transversely extending opening extending perpendicularly to the plane of said saw blade and threaded means fixedly positionable in said transverse opening to extend through said opening in said blade for retaining said hollow sleeve in position on said blade.

3. The combination of claim 2 wherein said saw-tooth edge of said saw is oriented at approximately 45° with respect to said blade.

4. The combination of claim 1 wherein said saw-tooth edge faces a flat edge of said blade.

5. A saw blade attachment for a knife comprising connector means removably connectable to a knife blade in the area of the blade adjacent the handle of a knife, said connector means comprising a hollow sleeve member including a slot extending therethrough dimensioned so as to be matingly fittable over a knife blade, and a saw blade including a saw-tooth edge and extending outwardly from said connector means at an acute angle relative to the axis of the aperture in the hollow sleeve member wherein said saw-tooth edge faces and is aligned with one edge of said blade.

6. The attachment of claim 5 wherein said sleeve member includes a transversely extending opening alignable with a transverse opening in said saw blade and threaded means fixedly positionable in said transverse opening in said sleeve member to also extend through said opening in said blade for permitting said hollow sleeve member to be fixedly retained in position on said blade.

7. The combination of claim 6 wherein said saw-tooth edge of said saw is oriented at approximately 45° with respect to the axis of the slot in said hollow sleeve member.

* * * * *